US009553407B2

(12) United States Patent
McDowall

(10) Patent No.: US 9,553,407 B2
(45) Date of Patent: Jan. 24, 2017

(54) ELECTRICAL PLUG RETAINER OUTLET

(71) Applicant: EATON INDUSTRIES MANUFACTURING GMBH, Morges (CH)

(72) Inventor: Gregor McDowall, Apples (CH)

(73) Assignee: EATON INDUSTRIES MANUFACTURING GMBH, Morges (CH)

( * ) Notice: Subject to any disclaimer, the term of this patent is extended or adjusted under 35 U.S.C. 154(b) by 0 days.

(21) Appl. No.: 14/385,181

(22) PCT Filed: Mar. 13, 2013

(86) PCT No.: PCT/EP2013/055164
§ 371 (c)(1),
(2) Date: Sep. 15, 2014

(87) PCT Pub. No.: WO2013/135780
PCT Pub. Date: Sep. 19, 2013

(65) Prior Publication Data

US 2015/0044900 A1 Feb. 12, 2015

(30) Foreign Application Priority Data

Mar. 16, 2012 (EP) ..... 12159995

(51) Int. Cl.
*H01R 13/639* (2006.01)
*H01R 13/627* (2006.01)
*H01R 103/00* (2006.01)

(52) U.S. Cl.
CPC ..... *H01R 13/6395* (2013.01); *H01R 13/6275* (2013.01); *H01R 13/6278* (2013.01); *H01R 2103/00* (2013.01)

(58) Field of Classification Search
CPC ..... H01R 13/62933; H01R 13/639; H01R 13/5395
USPC ..... 439/372
See application file for complete search history.

(56) References Cited

U.S. PATENT DOCUMENTS 3,801,757 A * 4/1974 Carissimi ..... H01R 13/62933 200/50.28
5,839,912 A * 11/1998 Schekalla ..... H01H 50/048 439/157
5,888,081 A * 3/1999 Konoya ..... H01R 13/62955 439/157
5,971,789 A * 10/1999 Sukegawa ..... H01R 13/6275 439/352

(Continued)

FOREIGN PATENT DOCUMENTS

CN 201667452 U 12/2010

*Primary Examiner* — Gary Paumen
(74) *Attorney, Agent, or Firm* — Leydig, Voit & Mayer, Ltd.

(57) ABSTRACT

An electrical plug retainer outlet includes a connector outlet including a switchable plug retainer assembly mounted on the connector outlet. The plug retainer assembly includes a retaining element, a switch, and a coupling unit connecting the switch and the retaining element. The outlet is configured such that by operating the switch, the retaining element is shifted between a neutral position and an engaged position. In the engaged position, the retaining element provides a form-fit connection, a frictional connection, or both, to a plug connected to the connector outlet. The retaining element interferes with an insulation of the plug.

12 Claims, 5 Drawing Sheets

(56) References Cited

U.S. PATENT DOCUMENTS

| | | | | |
|---|---|---|---|---|
| 6,132,231 | A * | 10/2000 | Suzuki | H01R 13/6275 439/352 |
| 6,533,598 | B1 | 3/2003 | Bentley et al. | |
| 7,156,682 | B1 | 1/2007 | Lai | |
| 7,322,845 | B2 * | 1/2008 | Regnier | H01R 13/6335 439/352 |
| 7,559,779 | B1 * | 7/2009 | Caines | H01R 13/62938 439/157 |
| 8,303,325 | B2 * | 11/2012 | Yang | H01R 13/6275 439/352 |
| 2003/0003786 | A1 * | 1/2003 | Bakker | H01R 13/4538 439/157 |
| 2005/0124201 | A1 * | 6/2005 | Lo | H01R 13/562 439/352 |
| 2009/0209122 | A1 * | 8/2009 | Heggemann | H01R 9/2625 439/157 |
| 2010/0178787 | A1 * | 7/2010 | Lux | H01R 13/4534 439/271 |
| 2010/0255708 | A1 | 10/2010 | Hsu | |
| 2011/0237108 | A1 | 9/2011 | Vass | |
| 2014/0170888 | A1 * | 6/2014 | Chien | H01R 13/6392 439/352 |
| 2015/0044898 | A1 * | 2/2015 | Dobler | H01R 13/6275 439/352 |

* cited by examiner

ELECTRICAL PLUG RETAINER OUTLET

CROSS-REFERENCE TO RELATED APPLICATIONS

This application is a U.S. National Stage Application under 35 U.S.C. §371 of International Application No. PCT/EP2013/055164 filed on Mar. 13, 2013, and claims benefit to European Patent Application No. EP 12159995.5 filed on Mar. 16, 2012. The International Application was published in English on Sep. 19, 2013, as WO 2013/135780 A1 under PCT Article 21(2).

FIELD

The invention refers to an electrical plug retainer outlet, more particularly, to the retention of power cord plugs plugged into the electrical plug retainer outlet.

BACKGROUND

In the field of electrical power connectors, US 2011/0237108 A1 is known, which refers to a locking power connector apparatus. A locking panel socket for making an electrical connection with a line plug comprises a socket connection portion having an end lace and the end lace having a plurality of recesses for receiving corresponding power pins of a line plug, a plug insertion channel that extends around the socket connection portion and a panel portion that extends around the plug insertion channel. The locking panel socket also includes within the socket connection portion a locking mechanism for restraining a power pin of a line plug from being withdrawn from one of the recesses and a release mechanism for releasing the locking mechanism to permit the power pin to be withdrawn from the recess. The release mechanism includes an actuation portion and a linking portion that links the actuation portion with the locking mechanism. The actuation portion is manually accessible on the panel and the linking portion extends from the actuation portion to the locking mechanism.

Further, U.S. Pat. No. 7,156,682 B1 discloses an electric socket including a rotation unit and a switching cap unit. The rotation unit abuts the conducting units inside the socket. The switching cap unit protrudes from the rest of the socket. The rotation unit may be moved along with the switching cap unit. When each of the two prongs of a plug is inserted into the two prong slots of the socket, a user may rotate the switching cap unit by a certain angle so that the long sides of the rotation unit may press against the two conducting units of the socket. The two conducting units of the socket seize and lock the two prongs of the plug. To take out the plug, a user may rotate the switching cap unit in the reversed direction by a certain angle, so the two long sides of the rotation unit no longer press against the two conducting units, and the plug may be taken out from the two slots.

In US 2010/0255708 A1, a socket with a plug retention structure is disclosed, which includes an upper housing, a lower housing, at least two flexible pieces, and a control unit. The lower housing includes at least two insertion holes. The interior of the lower housing defines an accommodating space. Two flexible pieces are placed in the accommodating space associated with the lower housing. Each of the two flexible pieces has a fulcrum and at least one flexible plate. One end of the flexible plate is connected to the fulcrum, and the other end of the flexible plate forms an abutting portion. The abutting portions of the two flexible pieces correspond to the two insertion holes. The control unit is movably placed in the accommodating space associated with the upper housing. The control unit is configured to selectively press the flexible plates.

Furthermore, CN 201667452 U relates to a switch socket with a lock catch. The switch socket with the lock catch comprises a shell of the socket and a socket reed arranged in the shell of the socket, and the shell of the socket is provided with a shift lever cam turn plate to guarantee that a plug is firmly contacted with the socket by arranging the lock catch.

U.S. Pat. No. 6,533,598 B1 discloses a lockable wall outlet electrical receptacle having a housing with a pair of vertically spaced electrical plug apertures formed in its front wall surface. An upper and a lower shaft have their front ends extending outwardly from the housing. The shafts have a structure formed in their peripheral surface that allows a predetermined number of degrees of rotation to lock the blade prongs of a male electrical plug in the wall outlet receptacle after they have been inserted into the electrical plug apertures. A mechanical structure having a lever arm for actuation connects the respective upper and lower shaft members so that they are rotated at the same time.

One drawback of the locking and releasing mechanism for restraining the power pin of a plug is, that the mechanism needs a rather voluminous installation space, the connector thus having a size that greatly exceeds that of a standard connector without locking feature, both in the lateral direction and in the insertion direction.

SUMMARY

An aspect of the invention provides an electrical plug retainer outlet, comprising: a connector outlet including a switchable plug retainer assembly mounted on the connector outlet, wherein the plug retainer assembly includes a retaining element, a switch, and a coupling unit connecting the switch and the retaining element. The outlet is configured such that by operating the switch, the retaining element is shifted between a neutral position and an engaged position. In the engaged position, the retaining element provides a form-fit connection, a frictional connection, or both, to a plug connected to the connector outlet. The retaining element interferes with an insulation of the plug.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
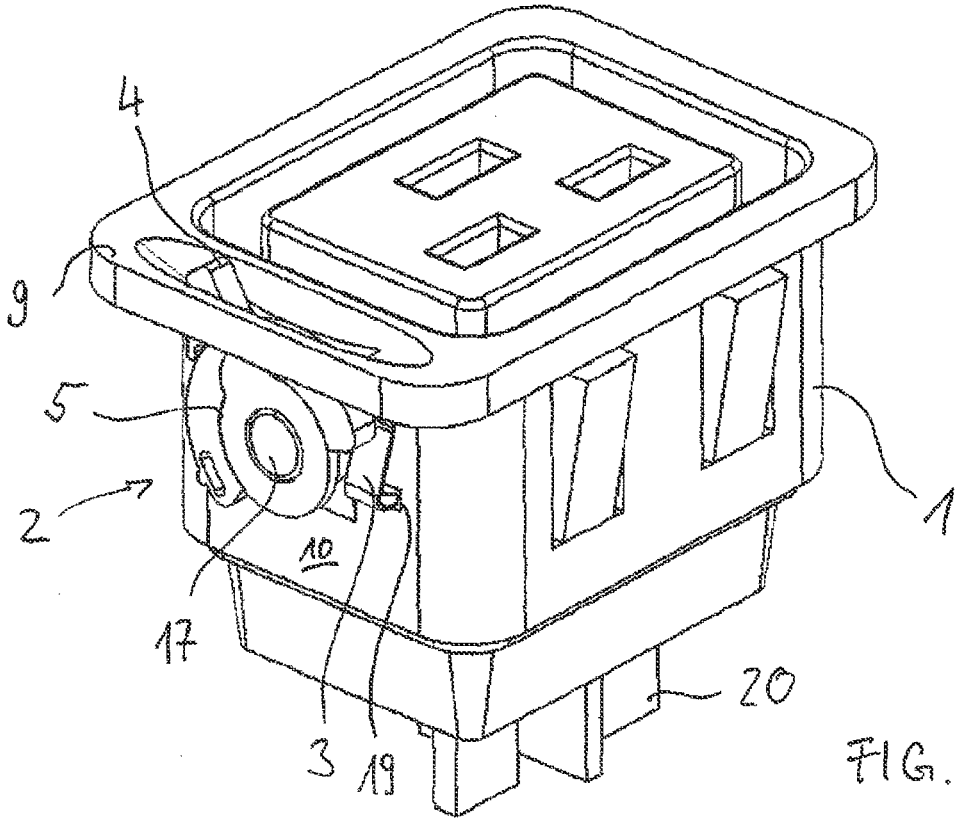
FIG. 1 shows an embodiment of the electrical plug retainer outlet according to the invention in neutral position in a perspective view.

An aspect of the invention provides an electrical outlet with a plug retention function of less additional size compared to an outlet without plug retention function. An aspect of the invention provides an electrical plug retainer outlet which returns power cord plugs plugged into the electrical plug retainer outlet, such outlets being suitable to distribute electrical power to various devices, such as desktop computers, servers, and rack systems. An aspect of the invention addresses when a plug may inadvertently or unintentionally become disengaged from an outlet, due to low mating forces between the power cord plug and the electrical power outlet.

The electrical plug retainer outlet according to the invention comprises a connector outlet with a switchable plug retainer assembly mounted to the connector outlet, the plug retainer assembly comprising a retaining element and a switch and coupling means connecting the switch and the retaining element, wherein by operating the switch, the retaining element is shifted between a neutral position and an engaged position, wherein in the engaged position, the retaining element provides a form-fit and/or frictional connection to a plug connected to the connector outlet, wherein the retaining element interferes with an insulation of the plug.

An advantage of the electrical plug retainer outlet according to the invention is, that the retaining element gets into contact with the plug, i.e. with the electrically isolated outer surface of the plug, which is usually made of plastic or rubber and thus provides a very good frictional connection and further may even allow the retaining element to slightly intrude into the plug surface material to establish a connection which has a form-fit fraction. The retaining element thus preferably comprises at least one tooth for contacting the plug, which tooth may be a metal tooth for easier intrusion, or, alternatively, a tooth with a rubber pad to increase friction.

A further advantage of the electrical plug retainer outlet according to the invention is, that the power pin or pins of the plug are not restrained. The mechanism to restrain a power pin is rather complex, compared to the switchable plug retainer assembly according to the invention, which is advantageously simple and may be assembled easily at one side of the retainer outlet.

Since the electrical plug retainer outlet according to the invention is not intended to restrain the power pins, there is yet a further advantage, that the electrical plug retainer outlet according to the invention may be applied with female as well as with male versions of a connector outlet. Female connectors are used for PDU output, for example, whereas male connectors are used for server/computer input. It does not matter, whether the plug or the outlet carries the male or female connector. Anyway, the retaining element interferes with the insulation of the plug.

According to a preferred embodiment, the switch is pivotably operated in a rotating plane and the retaining element is shifted between the neutral position and the engaged position in a transverse direction of the rotating plane. It is thus advantageously achieved, that the clamping action is transferred from the pivotable switch to the retention element through a generally rectangular deflexion. This allows the switchable plug retainer assembly to be used with panel mounted outlets. Furthermore preferably, the retaining element is shifted between the neutral position and the engaged position in a transverse direction of an insertion direction.

According to a further preferred embodiment, the switch is pivotably connected to a pivot, the pivot extending from a connector outlet outer wall in a direction parallel to the shifting direction of the rotating element. In the engaged position, the retaining element preferably interlocks the plug by at least compensating for a play of the plug in the connector outlet.

Preferably, the coupling means comprise a cam contour, the cam contour actuating the retaining element from the neutral position into the engaged position. The cam contour particularly comprises at least one cam slope or cam ramp, more preferably two cam slopes or cam ramps. Without actuation by the coupling means, the retaining element preferably returns resiliently into the neutral position. Furthermore preferably, the coupling means comprise a coupling ring, the coupling ring carrying a switch handle and a cam contour, wherein particularly, the coupling ring is pivotably mounted to the connector outlet outer wall via a pivot hub.

According to a further preferred embodiment, the switch handle projects through a flange of the connector outlet, which may easily be accessed by a user. In another embodiment, the coupling ring comprises a protrusion for snap-locking into a recess formed on the connector outlet outer wall to lock the switch handle in the engaged position. The user thus feels a click of the snap-lock when the assembly is locked in the engaged position. The coupling ring preferably comprises a locking state marking indicating whether the switch is in the engaged or neutral position.

Preferably, the coupling ring comprises a recess complementarily formed to accommodate a nose of the pivot hub, which provides advantageously a clocking feature between the two parts. The pivot hub preferably comprises snap-fit means to provide a snap-fit connection of the pivot hub on a pivot arranged on the connector outlet outer wall. Alternatively, a screw and washer may be used to secure the pivot hub on a pivot arranged on the connector outlet outer wall.

According to a further preferred embodiment, in the engaged position, the retaining element is arranged on a connector outlet outer wall, at least one contact tooth of the retaining element projecting into the connector outlet through at least one slot. The retaining element is preferably held to the connector outlet outer wall by the pivot hub. It is a further advantage, that the switchable plug retainer assembly may easily be assembled, particularly by snap-fit connections.

Figure 2:
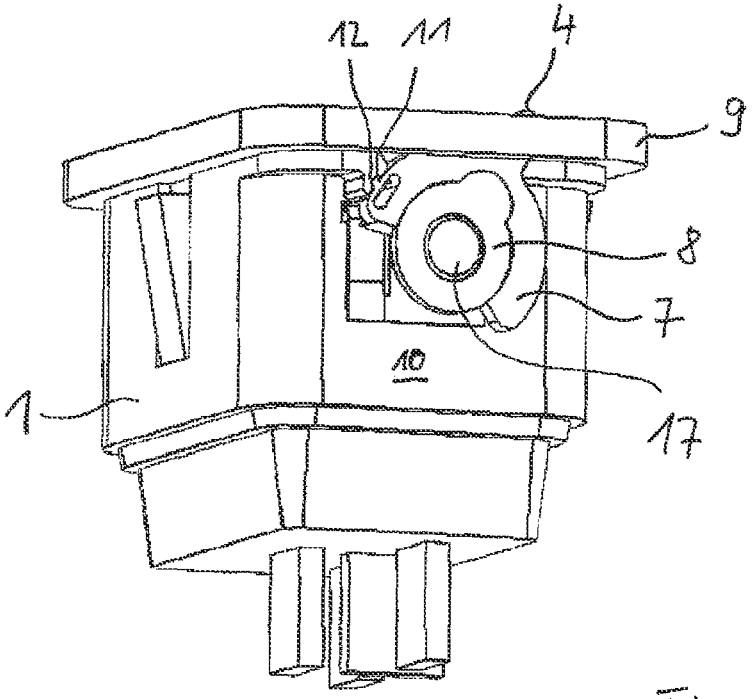
FIG. 2 shows the embodiment of FIG. 1 in engaged position and in a different perspective view.

In FIGS. 1 and 2 the electrical plug retainer outlet according to the invention is depicted in one possible embodiment, with a retaining element 3 in a neutral position in FIG. 1 and in engaged position in FIG. 2. As FIGS. 1 and 2 show different perspective views of the embodiment, both FIGS. will be described together. The electrical plug retainer outlet according to the invention comprises a connector outlet 1 which is intended to receive a plug or power cord plug in order to establish an electrical connection between contacts of the plug and contacts 20 of the connector outlet 1. According to the invention a switchable plug retainer assembly 2 is mounted to the connector outlet 1 which advantageously retains a plug connected to the outlet 1 and thus prevents the plug to slip out of the connector outlet 1, for example due to vibrations. It will be recognized that the plug is not locked in the connector outlet 1 in such a way that it may not be pulled out of the socket by force. The retaining function according to the invention is intended to prevent plugs becoming loose unintentionally. The plug retainer assembly 2 comprises the retaining element 3 and a switch 4 as well as coupling means 5 providing an operational connection between the retaining element 3 and the switch 4. By operating the switch 4 the retaining element 3 is shifted between the neutral position according to FIG. 1 and the engaged position according to FIG. 2, wherein in the engaged position the retaining element provides a form-fit and/or frictional connection to a plug connected to the connector outlet 1. The retaining element 3 thus at least comes into contact with the plug connected to the connector outlet 1. The retaining element 3 comprises two contact teeth 18 which protrude into the connector outlet 1 through respective slots 19. The retaining element 3 thus interlocks the plug by at least compensating for a play of the plug in the connector outlet 1. If the contact teeth 18 of the retaining element 3 slightly cut into the rubber coating of the plug, then a form-fit connection is established. If, however, the contact teeth 18 of the retaining element 3 just touch the surface of the plug, then a frictional connection is established. The contact teeth 18 may be metal teeth to enhance their intrusion into the plug surface. Alternatively the contact teeth 18 may comprise rubber pads applied to the contact faces in order to increase friction. The retaining element 3 is shifted between the neutral position outside of the connector outlet 1 and the engaged position inside the connector outlet 1 in a transverse direction of an insertion direction, which is that direction in which the plug is inserted into the connector outlet 1. Further, it will be recognized that the complete switchable plug retainer assembly 2 is advantageously arranged at one of the connector outlet outer walls 10. The electrical plug retainer outlet according to the invention thus does not need any increase in depth, i.e. no increase in size in the insertion direction, when compared to an outlet without a plug retaining function. Only a marginal increase in length at the connector outlet outer wall 10, where the switchable plug retainer assembly is mounted, is necessary. The increase in length is less than five millimeters, preferably less than four millimeters. It will be recognized that this slight increase in length refers to only one of the transverse directions, there is no increase in the second transverse direction or width direction.

According to the depicted embodiment, the switch 4 is pivotably operated in a rotating plane and the retaining element 3 is shifted between the neutral position and the engaged position in a transverse direction of the rotating plane. It is thus advantageously achieved, that the clamping action is transferred from the pivotable switch 4 to the retention element 3 through a generally rectangular deflection. This allows the switchable plug retainer assembly 2 to be used with panel mounted outlets 1. The switch 4 is pivotably connected to a pivot 17, the pivot 17 extending from the connector outlet outer wall 10 in a direction parallel to the shifting direction of the retaining element 3.

Figure 3:
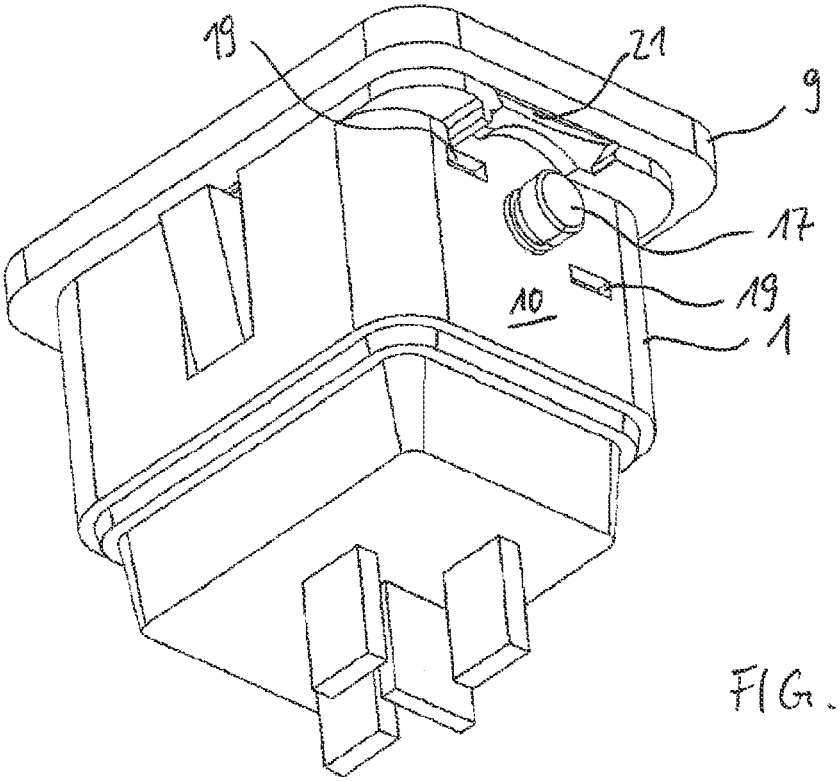
FIGS. 3 to 6 show different single components of the embodiment according to FIG. 1 in perspective views.

In FIGS. 3 to 6, single parts of the electrical plug retainer outlet are shown and will be described with respect to the embodiment according to FIGS. 1 and 2. In FIG. 3 the connector outlet 1 is shown. All the additional features as described before are arranged to one end face of the connector outlet 1, referred to as connector outlet outer wall 10, or just wall 10. The pivot 17 is arranged on the wall 10, as well as two slots 19 for the contact teeth 18 of the retaining element 3, shown in detail in FIG. 4. The connector outlet 1 has a flange 9, into which a further slot 21 for the switch 4 is formed. An outer wall recess 12 is intended to provide a snap-fit locking feature for a protrusion 11 formed on the coupling ring 7, shown in detail in FIG. 5.

Figure 4:
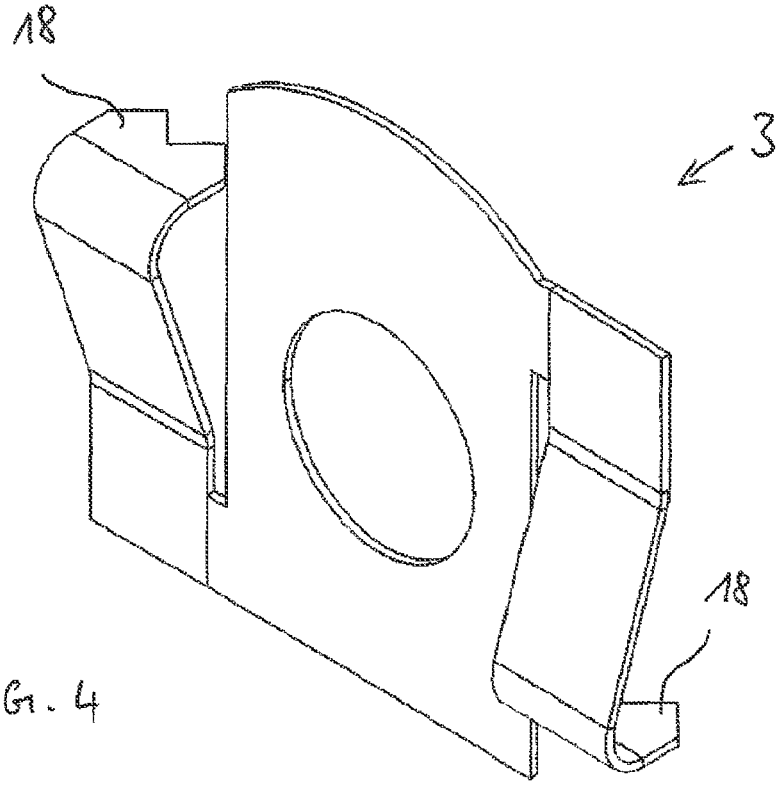

In FIG. 4, the retaining element 3 is shown. The retaining element 3 is a stamped sheet metal part, for example. The contact teeth 18 are angled in order to contact the plug and they are bent back in the form of a ramp in order to provide a spring force pulling the teeth 18 back out off the plug and out off the connector outlet 1 if the switch 4 is set back to the neutral position.

Figure 5:
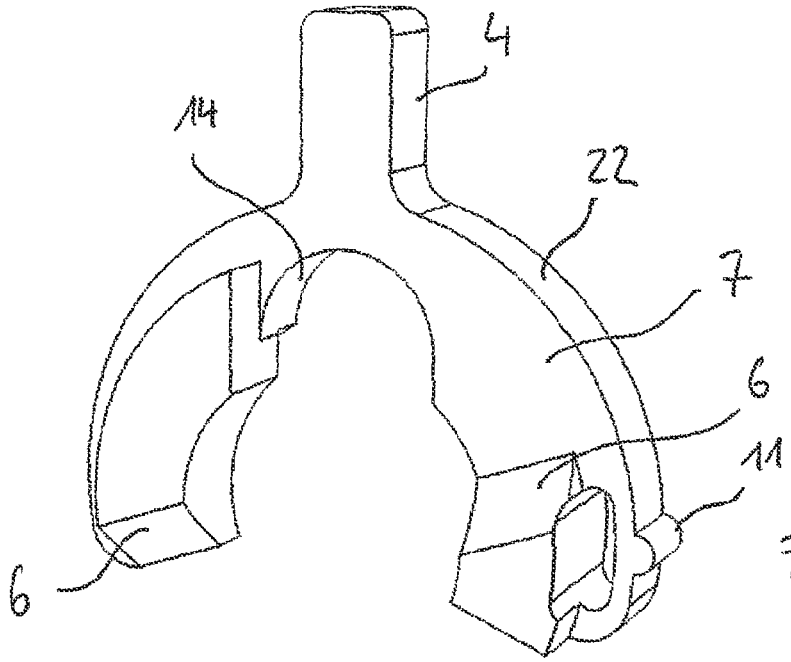
Figure 6:
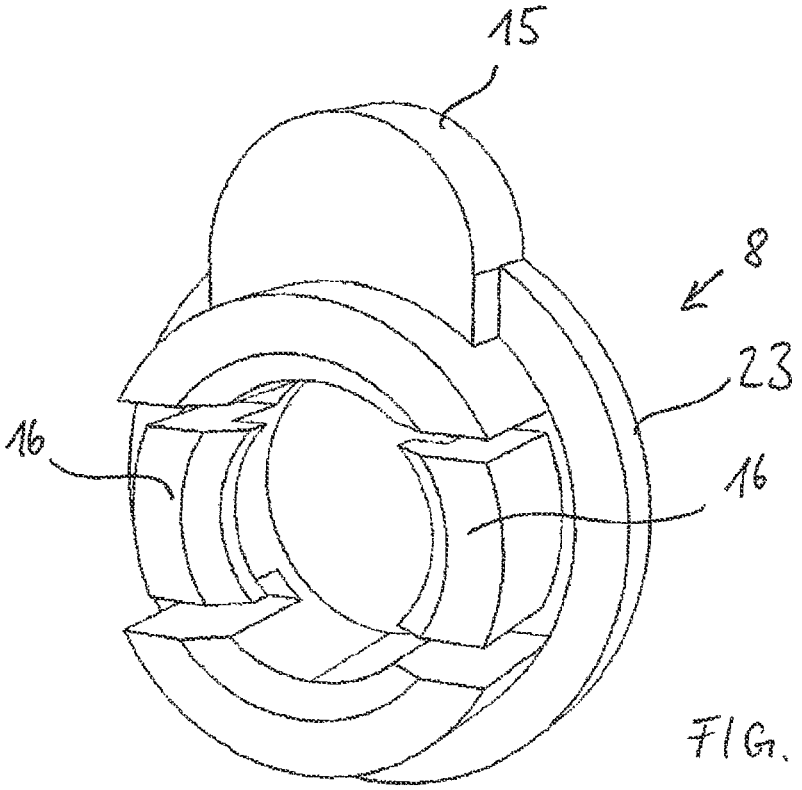
Figure 7:
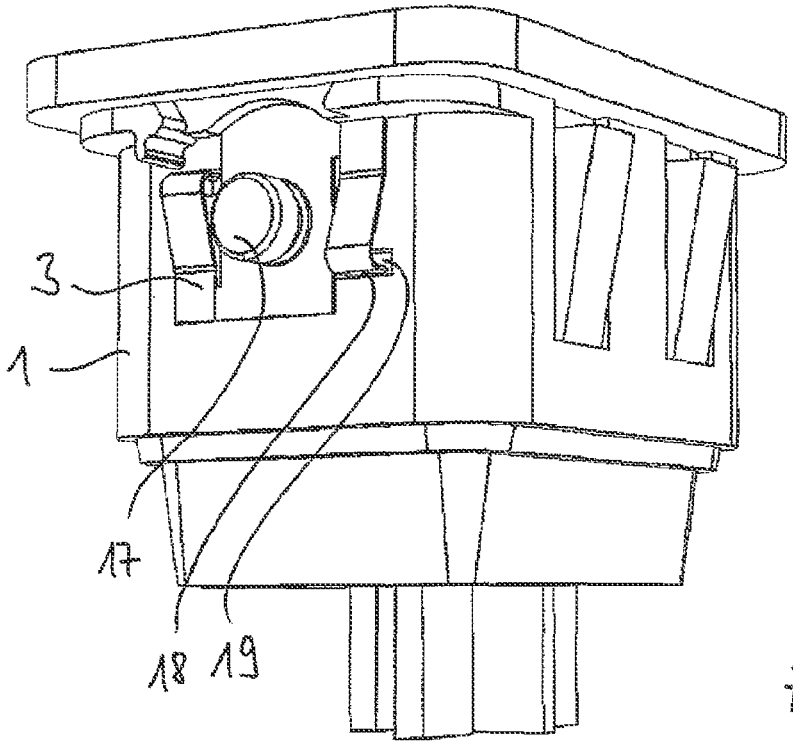
FIGS. 7 to 10 show the embodiment according to FIG. 1 in different states of assembly.

FIGS. 5 and 6 show the two parts of the coupling means 5. In FIG. 5, a coupling ring 7 in the form of an arc is shown, with cam contours 6 in the form of ramps at both ends of the arc. From the middle of the arc a switch handle 4 extends radially outward with respect to the arc, which switch handle 4 is intended to protrude through the slot 21 in the flange 9 of the connector outlet 1, cf. FIG. 3. It will be recognized that the coupling ring 7 could as well comprise a closed ring structure instead of the arc shown in the present embodiment. Adjacent to the switch handle 4, there may advantageously be applied a locking state marking 22 on the outer circumferential surface of the coupling ring 7, which may for example be a green marking on one side of the handle 4 to indicate a locked state of the switchable plug retainer assembly 2 and a red marking on the other side of the handle 4 to indicate an unlocked state. Furthermore, the coupling ring 7 comprises a protrusion 11 extending radially outward from the circumferential surface near one end of the arc in order to provide a locking feature that can be operationally connected by snap-fit to the outer wall recess 12 arranged beneath the flange 9 at the connector outlet outer wall 10, cf. FIG. 3. In the centre of the coupling ring 7, there is a circular clearance into which a pivot hub 8 can be inserted.

The pivot hub 8 is shown in FIG. 6. As a clocking feature, the coupling ring 7 comprises a coupling ring recess 14 which matches with a nose 15 on the pivot hub 8. Further, the pivot hub 8 comprises a shoulder 23 which engages with the coupling ring 7. The pivot hub 8 further comprises snap-fit means 16 to engage a groove on the pivot 17 on the connector outlet outer wall 10, which allows to attach the complete set of parts of the switchable plug retainer assembly 2 to the wall 10 by snap-fitting the pivot hub 8 onto the pivot 17. Alternatively, however, the hub 8 may as well be secured to the pivot 17 by a screw and a washer, for example.

The advantageously simple snap-fit assembly method of attaching the switchable plug retainer assembly 2 to the connector outlet 1 will now be described with respect to FIGS. 7 to 10. Regarding FIG. 7, the retaining element 3, a sheet metal spring is attached to the connector outlet outer wall 10 by clipping the retaining element 3 with its central clearance onto the pivot 17 and aligning the contact teeth 18 with the respective slots 19 on the connector outlet outer wall 10.

Figure 8:
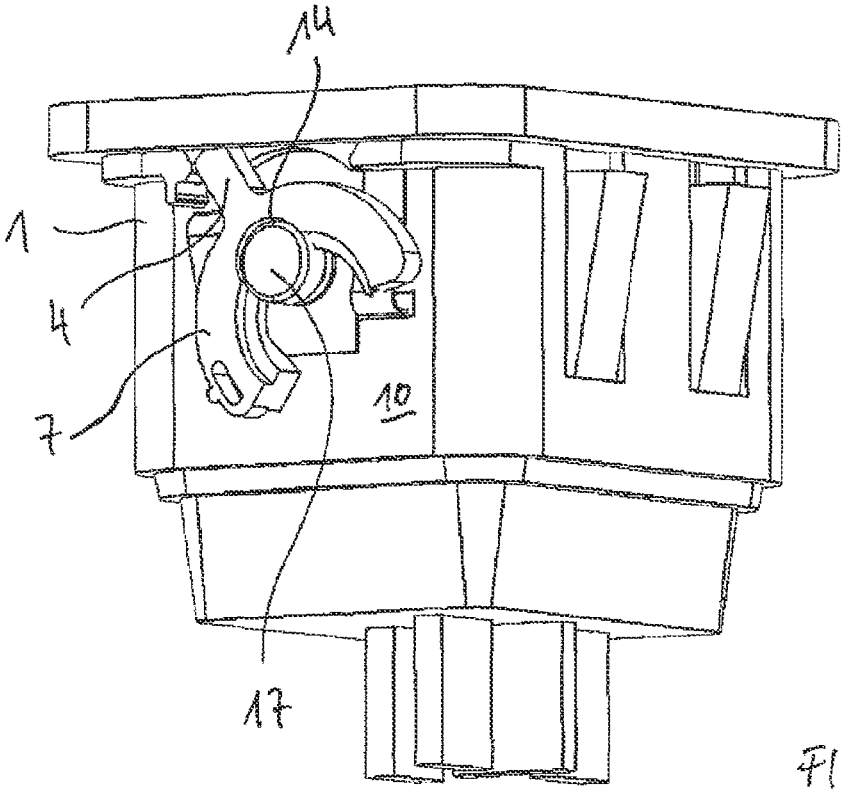

From FIG. 8, it will be recognized that the coupling ring recess 14 is further intended and formed to accept the pivot 17 during assembly of the coupling ring 7, because it is only possible to insert the switch handle 4 into the slot 21 when the coupling ring 7 is in the position depicted in FIG. 8.

Figure 9:
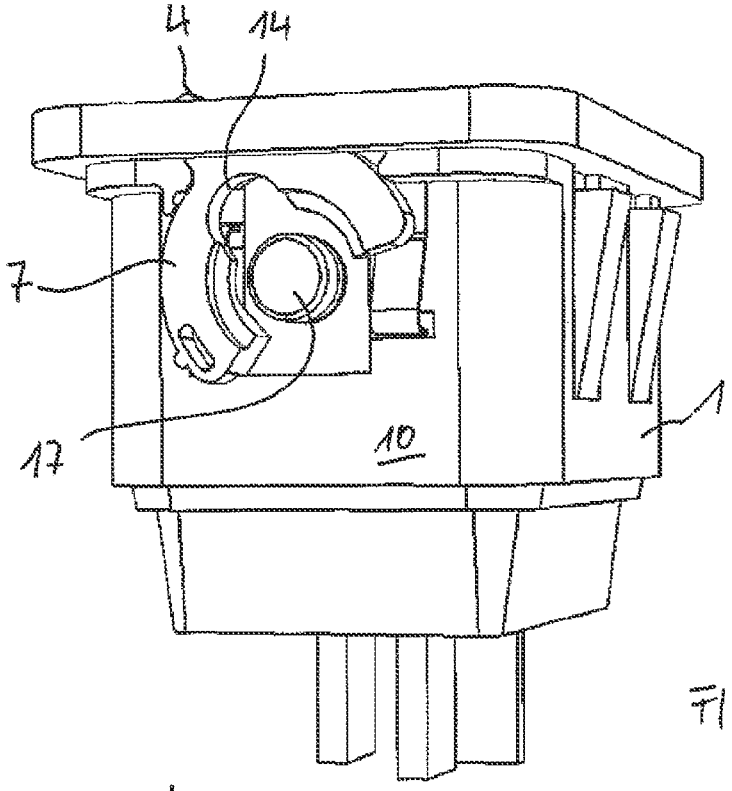
Figure 10:
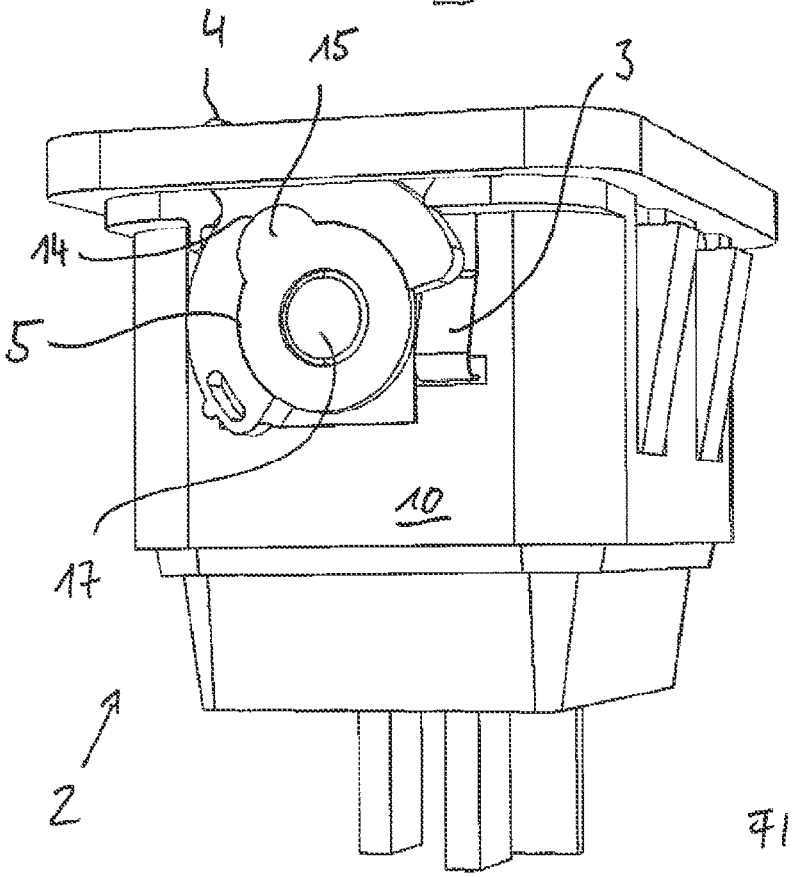

In FIG. 9 the coupling ring 7 is depicted in its final position, the switch handle 4 being fully inserted into the slot 21 and the central clearance of the coupling ring 7 being concentrically aligned with the pivot 17. The retaining element 3 is held in place by the coupling ring 7. Now, the pivot hub 8 may advantageously be snapped onto the pivot 19, thus locking at the same time the coupling ring 7 pivotally on the pivot 17, which is depicted in FIG. 10.

The person skilled in the art will recognize that, although the figures are shown for a female outlet the switchable plug retainer assembly will perform in exactly the same manner for a female plug and male socket. The male version outlet can as well be equipped with the switchable plug retainer assembly, which would remain exactly the same, in the same relative location on the outlet and operate in the same fashion. According to preferred embodiments of the invention, the switchable plug retainer assembly is compatible with IEC60320 female outlets C13, C15, C17 and C19 plus male outlets C14, C16, C18 and C20.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

REFERENCE NUMERALS

1 connector outlet
2 switchable plug retainer assembly
3 retaining element
4 switch, switch handle
5 coupling means
6 cam contour
7 coupling ring
8 pivot hub
9 flange
10 connector outlet outer wall
11 protrusion
12 outer wall recess
13 coupling ring recess
14 nose
15 snap-fit means
16 pivot
17 contact tooth
18 slot
19 contact
20 slot for switch
21 locking state marking
22 shoulder

The invention claimed is:

1. An electrical plug retainer outlet, comprising:
a connector outlet;
a switchable retainer assembly mounted on the connector outlet, the switchable plug retainer assembly including a retaining element, a switch, and a coupling unit connecting the switch and the retaining element,
wherein the switch is configured to shift the retaining element from a neutral position to an engaged position,
wherein the retaining element is configured to, in the engaged position, interlock a plug connected to the connector outlet to provide a form-fit connection, a frictional connection, or both, with the plug,
wherein the retaining element is configured to, in the engage position, interlock an insulating portion of the plug,
wherein the coupling unit includes a cam contour, and
wherein the cam contour is configured to actuate the retaining element from the neutral position into the engaged position.

2. The outlet of claim 1, wherein the cam contour includes a cam slope or cam ramp.

3. The outlet of claim 1, configured such that, without actuation by the coupling unit, the retaining element resiliently returns into the neutral position.

4. An electrical plug retainer outlet, comprising:
a connector outlet;
a switchable plug retainer assembly mounted on the connector outlet, the switchable plug retainer assembly including a retaining element, a switch, and a coupling unit connecting the switch and the retaining element,
wherein the switch is configured to shift the retaining element from a neutral position to an engaged position,
wherein the retaining element is configured to, in the engaged position, interlock a plug connected to the connector outlet to provide a form-fit connection, a frictional connection, or both, with the plug, and
wherein the retaining element is configured to, in the engage position, interlock an insulating portion of the plug,
wherein the coupling includes a coupling ring, and
wherein the coupling ring includes a switch handle and a cam contour.

5. The outlet of claim 4, wherein the coupling ring is pivotably mounted to the connector outlet outer wall via a pivot hub.

6. The outlet of claim 4, wherein the switch handle projects through a flange of the connector outlet.

7. The outlet of claim 4, wherein the coupling ring includes a protrusion configured to snap-lock into a recess formed on the connector outlet outer wall, to lock the switch handle in the engaged position.

8. The outlet of claim 5, wherein the coupling ring includes a recess complementarily formed to accommodate a nose of the pivot hub.

9. The outlet of claim 5, wherein the pivot hub includes snap-fit unit configured to provide a snap-fit connection of the pivot hub on a pivot arranged on the connector outlet outer wall.

10. The outlet of claim 5, wherein the retaining element is held to the connector outlet outer wall by the pivot hub.

11. The outlet of claim 4, wherein the coupling ring includes a locking state marking configured to indicate whether the switch is in the engaged or neutral position.

12. An electrical plug retainer outlet, comprising:
a connector outlet including a switchable plug retainer assembly mounted on the connector outlet, wherein the plug retainer assembly includes a retaining element, a switch, and a coupling unit connecting the switch and the retaining element,
wherein the outlet is configured such that by operating the switch, the retaining element is shifted between a neutral position and an engaged position, wherein, in the engaged position, the retaining element provides a form-fit connection, a frictional connection, or both, to a plug connected to the connector outlet, wherein the retaining element interferes with an insulation of the plug, and wherein the retaining element is arranged on a connector outlet outer wall, at least one contact tooth of the retaining element projecting into the connector outlet through at least one slot.

* * * * *